US012422206B2

(12) United States Patent
Akdaş

(10) Patent No.: US 12,422,206 B2
(45) Date of Patent: Sep. 23, 2025

(54) AMMUNITION FEEDING SYSTEM

(71) Applicant: AKDAŞ SILAH ANONIM ŞIRKETI, Konya (TR)

(72) Inventor: Selim Akdaş, Konya (TR)

( * ) Notice: Subject to any disclaimer, the term of this patent is extended or adjusted under 35 U.S.C. 154(b) by 56 days.

(21) Appl. No.: 18/524,505

(22) Filed: Nov. 30, 2023

(65) Prior Publication Data

US 2024/0219135 A1 Jul. 4, 2024

(30) Foreign Application Priority Data

Dec. 28, 2022 (TR) ..... 2022/021008

(51) Int. Cl.
*F41A 9/70* (2006.01)
*F41A 9/69* (2006.01)

(52) U.S. Cl.
CPC . *F41A 9/70* (2013.01); *F41A 9/69* (2013.01)

(58) Field of Classification Search
CPC ..... F41A 3/66; F41A 9/55; F41A 9/62; F41A 9/65; F41A 35/06; F41A 9/69; F41A 9/70
See application file for complete search history.

(56) References Cited

U.S. PATENT DOCUMENTS 3,805,434 A * 4/1974 Sudano ..... F41A 21/10 42/77
4,061,074 A * 12/1977 Johnson ..... F41A 9/30 89/33.25
4,586,281 A * 5/1986 Chesnut ..... F41A 9/65 42/50
4,867,039 A * 9/1989 Dobbins ..... F41C 7/02 89/146
5,386,657 A * 2/1995 Racheli ..... F41A 9/69 42/50
6,032,395 A * 3/2000 Bentley ..... F41A 9/55 89/33.02
6,293,040 B1 * 9/2001 Luth ..... F41A 11/02 42/75.01
6,389,948 B1 * 5/2002 Beckmann ..... F41A 9/04 89/33.17
6,622,606 B1 * 9/2003 Neal ..... F41A 9/34 89/34
7,503,138 B2 * 3/2009 Tal ..... F41A 9/83 42/87
8,356,539 B2 * 1/2013 Gonzalez ..... F41A 9/57 89/33.14
8,393,107 B2 * 3/2013 Brown ..... F41C 27/00 42/105
8,839,709 B1 * 9/2014 Crye ..... F41A 9/74 89/157
9,528,784 B2 * 12/2016 Roberts ..... F41A 9/70
10,605,553 B1 * 3/2020 Collazo ..... F41C 7/00
11,162,748 B2 * 11/2021 Noonan ..... F41A 11/00
D987,763 S * 5/2023 Overstreet ..... D21/573
11,662,166 B2 * 5/2023 Overstreet ..... F41A 9/70 42/50
D1,020,970 S * 4/2024 Overstreet ..... D21/573
(Continued)

*Primary Examiner* — Michael D David
(74) *Attorney, Agent, or Firm* — Egbert, McDaniel & Swartz, PLLC

(57) ABSTRACT

Disclosed is an ammunition feeding system for firearms having a double round feeding magazine, which facilitates the feeding of ammunition into the firing chamber and prevents the position of the ammunition in the magazine from changing and/or shifting during the feeding process.

6 Claims, 2 Drawing Sheets

(56) References Cited

U.S. PATENT DOCUMENTS

| | | | | |
|---|---|---|---|---|
| D1,023,215 | S * | 4/2024 | Overstreet | D21/573 |
| 12,111,128 | B2 * | 10/2024 | Moore | F41A 3/66 |
| 12,130,110 | B2 * | 10/2024 | Kielsmeier | F41A 9/70 |
| 2013/0025177 | A1 * | 1/2013 | Bovensiep | F41C 23/00 42/71.01 |
| 2014/0230297 | A1 * | 8/2014 | Larson, Jr. | F41A 19/11 42/6 |
| 2014/0237878 | A1 * | 8/2014 | Lambert | F41A 3/66 42/75.01 |
| 2015/0176938 | A1 * | 6/2015 | Micklethwaite | F41A 19/44 89/127 |
| 2016/0327353 | A1 * | 11/2016 | DiChario | F41A 9/70 |
| 2016/0327354 | A1 * | 11/2016 | DiChario | F41A 9/62 |
| 2019/0226776 | A1 * | 7/2019 | DiChario | F41A 3/26 |
| 2019/0226779 | A1 * | 7/2019 | DiChario | F41A 9/71 |
| 2024/0219135 | A1 * | 7/2024 | Akdas | F41A 9/70 |

* cited by examiner

AMMUNITION FEEDING SYSTEM

FIELD OF THE INVENTION

The invention relates to an ammunition feeding system for firearms, which facilitates the feeding of ammunition and prevents ammunition from shifting during feeding.

In particular, the invention relates to an ammunition feeding system for firearms comprising a double round feeding magazine, which facilitates the feeding of ammunition into the firing chamber and prevents the position of the ammunition in the magazine from changing and/or shifting during the feeding process.

BACKGROUND OF THE INVENTION

In order for firearms to become ready for firing, especially weapons with double round feeding magazines, the ammunition in the magazine must be fed/carried into the firing chamber. During this process, while the ammunition to be fired is taken from the magazine and fed into the firing chamber, the position of the ammunition in the magazine is changed/shifted as a result of the feeding mechanism contacting the next ammunition in the magazine. As a result of the next ammunition in the magazine being tilted in a different direction in the magazine due to the movement of the feeding mechanism, problems may occur during firing such as not seating in the firing chamber and jamming as a result of feeding at the wrong angle. This leads to various failures, especially during consecutive firing, which can render the weapon temporarily or permanently unusable and create dangerous situations for the user.

A patent document U.S. Pat. No. 10,605,553B1 in the prior art discloses a shotgun mechanism for automatic ammunition loading, comprising a detachable magazine. The mechanism comprises an interconnected upper and lower receiver assembly, a magazine suitable for sequential insertion of multiple shotgun cartridges and detachably connected to the lower receiver assembly, forward and reverse ammunition feed ramps, a base plate for carrying ammunition in the magazine, and a spring follower for pushing the ammunition into the receiver assembly. The mechanism also includes a short recoil operation mechanism with a hand guard to support the barrel connected to the upper receiver during firing. The document does not mention any solution to facilitate the ammunition feeding process and to prevent ammunition shifting during feeding.

Therefore, there is a need for developing an ammunition feeding system that facilitates the feeding of the bullet/ammunition into the firing chamber of a firearm, prevents errors such as jamming during feeding, and prevents the position of the ammunition in the magazine from being changed and/or shifted during the feeding process.

BRIEF SUMMARY OF THE INVENTION

The present invention relates to an ammunition feeding system that meets the requirements mentioned above, eliminates possible disadvantages and provides some additional advantages.

The main purpose of the ammunition feeding system, which is the subject of the invention, is to provide an ammunition feeding system that facilitates and improves the process of inserting the bullet/ammunition into the firing chamber in firearms.

Another purpose of the invention is to provide a functional ammunition feeding system that prevents the position of the ammunition waiting to be fired in the magazine from changing and/or shifting during the feeding process.

Another purpose of the invention is to provide an effective ammunition feeding system that prevents failures such as jamming and double feeding caused by ammunition shifting during automatic/consecutive firing.

Another purpose of the invention is to provide a safe ammunition feeding system that prevents the firearm from becoming temporarily or permanently unusable and the prevents the occurrence of dangerous situations for the user.

A further purpose of the invention is to provide a practical ammunition feeding system which enables the automatic firing process to be carried out without failure and to avoid loss of time.

In order to achieve the above objectives in their most general form, the ammunition feeding system comprises at least one magazine, which is suitable for the sequential placement of ammunition containing at least one ammunition core and at least one cartridge case suitable for firing and launching, and at least one firing chamber, which allows the ammunition taken from the magazine to be positioned in a manner suitable for firing/launching, which is suitable for use in at least one firing mechanism that allows the launching of the core by firing the ammunition, facilitating the feeding of the ammunition into the firing chamber, preventing jams and failures, and preventing the position of the ammunition in the magazine from changing/shifting, the system comprises at least one ammunition feeding element for removing the ammunition from the magazine and inserting it into the firing chamber and at least one correction element for adjusting and/or correcting the position of the ammunition by contacting the ammunition in the magazine.

The structural and characteristic features and all advantages of the invention will be more clearly understood by means of the figures given below and the detailed description written with reference to these figures, and therefore, evaluation should be made by taking these figures and detailed description into consideration.

BRIEF DESCRIPTION OF THE SEVERAL VIEWS OF THE DRAWINGS

In order to best understand the structure and advantages of the present invention, evaluation should be together with the figures described below.

PART REFERENCES

1. Ammunition
2. Magazine
3. Feeding element
4. Correction element
4*a*. Correction slot

DETAILED DESCRIPTION OF THE INVENTION

In this detailed description, the preferred embodiments of the ammunition feeding system of the invention are described solely for the purpose of a better understanding of the subject matter and in a non-limiting manner.

Figure 1:
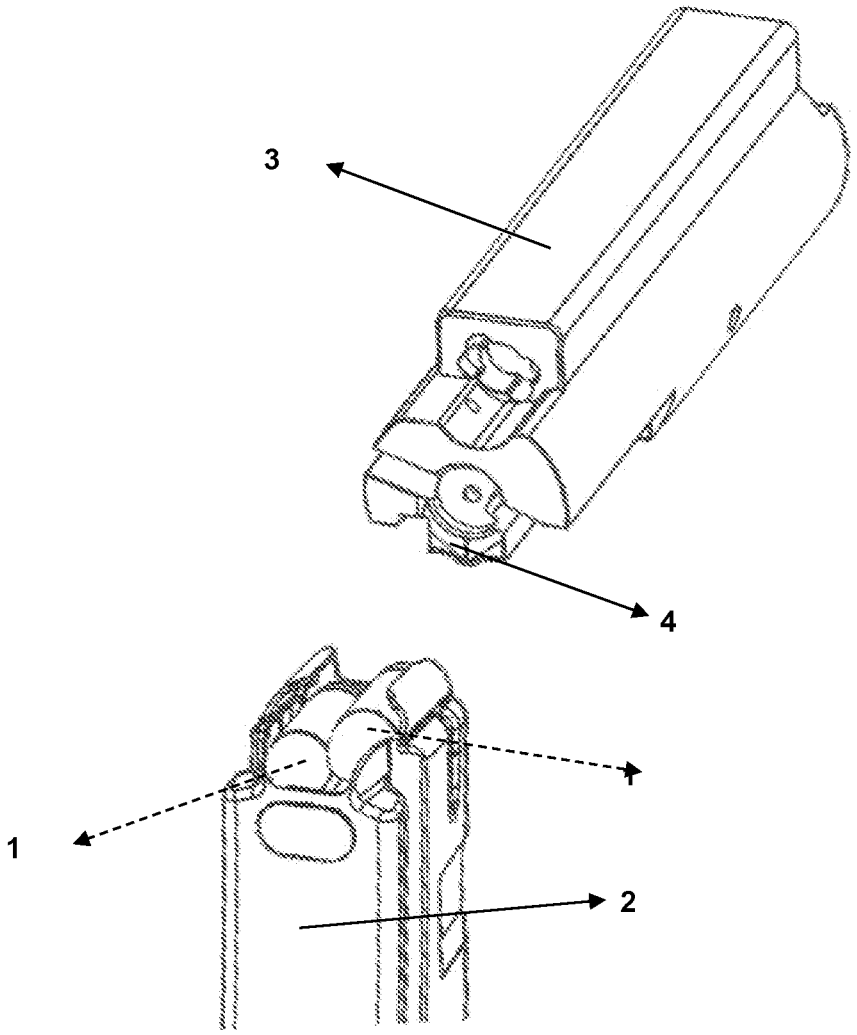
FIG. 1 is a perspective view of the ammunition feeding system which is the subject of the invention.
Figure 2:
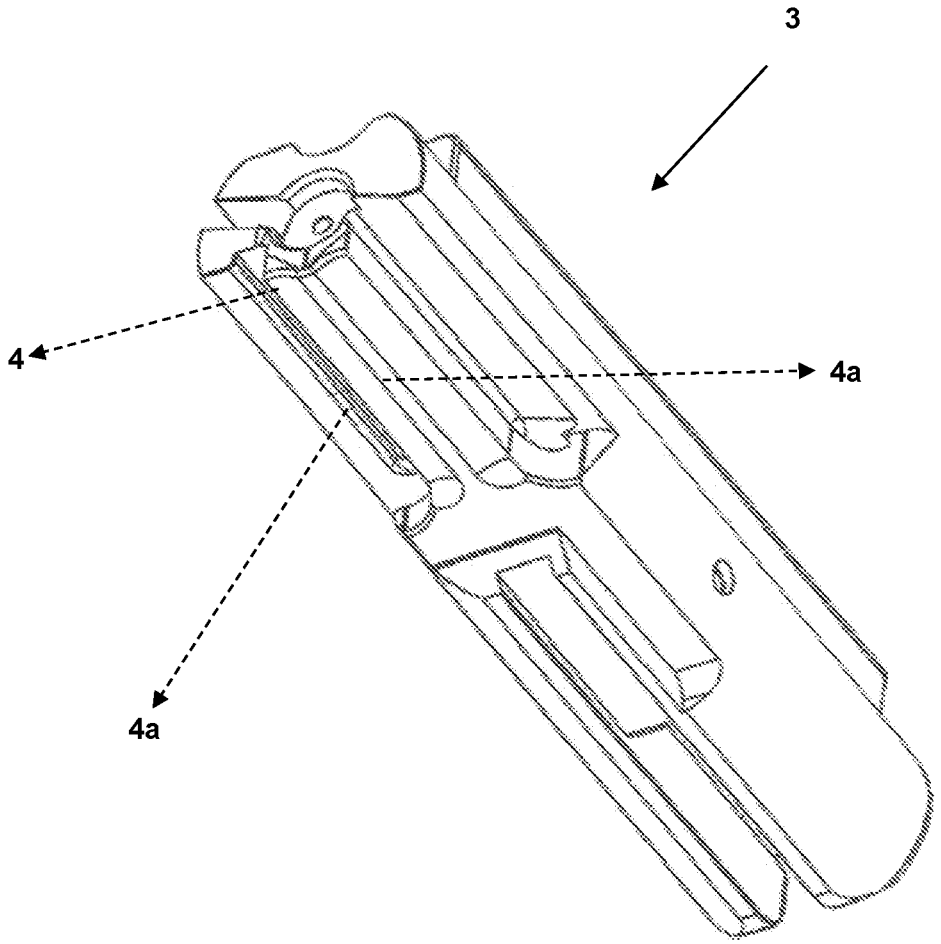
FIG. 2 is another perspective view of the ammunition feeding system which is the subject of the invention.

The ammunition feeding system developed with the present invention, whose sample view is given in FIG. 1, that comprises at least one magazine (2) suitable for sequential placement of at least one ammunition (1), preferably a bullet or cartridge, containing at least one ammunition core suitable for firing and at least one casing that enables the ammunition core to be carried inside, and a firing chamber that allows positioning of the ammunition (1) taken from said magazine (2) in a manner suitable for firing/launching, that preferably operates with a double round feeding magazine and that is suitable for use in at least one firing mechanism that enables the ammunition core to be launched by firing the ammunition (1), that facilitates the insertion of the ammunition (1) taken from the magazine (2) into the firing chamber, prevents jamming and failures that occur during the feeding process, and prevents the change/shifting of the position of the ammunition (1), wherein the system comprises at least one ammunition feeding element (3) located on the firing mechanism, which enables the ammunition (1) in the magazine (2) to be taken and placed in the firing chamber; at least one correction element (4) that allows adjustment and/or correction of the position of the ammunition (1) by contacting the ammunition (1) in the magazine (2) by moving the feeding element (3) close to the magazine (2), which is located on the side of the feeding element (3) which is close to the magazine (2), that is preferably in a circular form, with the surface close to the ammunition (1) compatible with the form of the surface of the casing away from the bullet, preferably comprising at least one straightening slot (4*a*) in the form of a hollow half-cylinder extending along the feeding element (3), that comprises at least two correction slots (4*a*) located parallel to each other on the extension axis of the feeding element (3), which enables the position of two ammunitions (1) to be corrected simultaneously in the magazine (2), preferably suitable for use with the weapon mechanism operating with a magazine with a double round feed magazine.

In an exemplary implementation of the ammunition feeding system developed with the present invention, the ammunition (1) ready for firing is positioned in the magazine (2). During firing, the ammunition (1) in the magazine (2) is taken by means of the feeding element (3) and inserted into the firing bed, and the firing process is carried out. In this way, it is ensured that the ammunition (1) to be fired is brought to the ready position. During this process, the feeding element (3) moves towards the magazine (2) and the correction element (4), which is located on the side of the feeding element (3) closest to the magazine (2), is made to contact the outer surface of the ammunition (1) waiting in the magazine (2). With the correction element (4) contacting the ammunition (1) in the magazine (2), the position of the ammunition (1) is corrected and it is directed in a way that does not allow jamming or failure in the next feeding operation.

By means of the ammunition feeding system developed with the present invention, it is ensured that the bullet/ammunition in firearms is facilitated to be inserted into the firing chamber, and failures such as jamming during feeding are prevented. In addition, a safe, practical, effective and functional ammunition feeding system is provided that prevents the ammunition from being positioned and/or shifted during the feeding process.

The invention claimed is:

1. An ammunition feeding system for use in a firing mechanism so as to enable at least one ammunition core to be launched by firing the ammunition, the ammunition feeding system comprising:

at least one magazine adapted to allow sequential placement of at least one ammunition therein, the at least one magazine comprising:

the at least one ammunition core adapted to be fired; and at least one casing that carries said at least one ammunition core therein; and a firing chamber adapted to position the ammunition taken from said at least one magazine in order to allow for a firing of the ammunition;

at least one ammunition feeding element positioned on the at least one firing mechanism and adapted to enable the ammunition in said at least one magazine to be taken and to be placed in said firing chamber; and at least one correction element adapted to allow adjustment and correction of a position of the ammunition by contacting the ammunition in said at least one magazine by moving of said at least one ammunition feeding element approaching said at least one magazine, wherein said at least one correction element is located on a side of said at least one ammunition feeding element close to said at least one magazine.

2. The ammunition feeding system of claim 1, wherein the ammunition is a bullet or a cartridge.

3. The ammunition feeding system of claim 1, wherein the firing mechanism has a double round feeding magazine.

4. The ammunition feeding system of claim 1, wherein a surface of said at least one correction element close to the ammunition is of a circular shape that is compatible with a shape of a surface of said at least one casing in a location away form the ammunition.

5. The ammunition feeding system of claim 1, wherein said at least one correction element has at least one correction slot with a hollow half-cylinder shape extending along said at least one ammunition feeding element.

6. The ammunition feeding system of claim 1, further comprising:

at least a pair of correction slots positioned parallel to each other along an axis of said at least one ammunition feeding element, said at least a pair of correction slots adapted to allow a correction of the position of a pair of ammunitions simultaneously in said at least one magazine for use with a double round feeding magazine of the firing mechanism.

* * * * *